United States Patent [19]

Blue

[11] Patent Number: 5,002,003

[45] Date of Patent: Mar. 26, 1991

[54] BOAT MOORING DEVICE

[75] Inventor: James Blue, North Miami, Fla.

[73] Assignee: J & B Auto Matic, Inc., Hialeah, Fla.

[21] Appl. No.: 533,179

[22] Filed: Jun. 4, 1990

[51] Int. Cl.[5] ..... B63R 21/04

[52] U.S. Cl. ..... 114/230; 114/254; 242/86.5 A

[58] Field of Search ..... 114/230, 343, 253, 264, 114/351, 201 R, 251, 254, 361; 441/3; 242/86.5 R, 86.5 A, 107, 107.4 R, 107.6, 107.7, 106; 191/12 R, 12.2 R

[56] References Cited

U.S. PATENT DOCUMENTS

| | | | |
|---|---|---|---|
| 1,811,400 | 6/1931 | McClellan | 114/230 |
| 3,012,736 | 12/1961 | Brust | 114/230 |
| 3,851,613 | 12/1974 | Armour | 114/230 |
| 4,697,537 | 10/1987 | Smith | 114/230 |
| 4,846,090 | 7/1989 | Palmquist | 114/230 |

*Primary Examiner*—Joseph F. Peters, Jr.

*Assistant Examiner*—Clifford T. Bartz

*Attorney, Agent, or Firm*—Charles J. Prescott

[57] ABSTRACT

A boat mooring device connectable into a suitable hole formed into the deck of a boat, the device including a deck plate, a trunnion connected and extending from the unexposed surface of the deck plate, and a spring loaded rope wheel rotatably mounted about a transverse axis at the other end of the trunnion. The device is structured so that rope stored on the rope wheel may be payed out from, or retracted unto, the rope wheel through an aperture in the deck plate as desired. Thereafter, pivotally closing a draw lever hinge connected atop the deck plate's exposed surface activates a spring loaded pawl which lockably engages into one of a plurality of notches formed into the periphery of the rope wheel. When the device is in its closed and locked position, a relatively smooth and uninterrupted surface with the boat deck is provided, the locked mooring rope extending out through the deck plate aperture a desired length for connection to a dock or the like.

5 Claims, 2 Drawing Sheets

BOAT MOORING DEVICE

BACKGROUND OF THE INVENTION

This invention relates generally to boat mooring devices, and more particularly to a self-locking, deck mounted boat mooring device which replaces conventional deck cleats.

Presently, most modern boats utilize a fixed and exposed deck cleat to which a mooring rope or line is attached for tying the boat to a dock or other fixed or floating objects. These conventional deck cleats are notorious for destroying bare feet or causing a deck hand to stumble. Additionally, the deck hand must also have available from a separate storage place a dock line connectable to each such cleat.

The present invention provides a self-locking boat mooring device to replace conventional deck cleats which provides storage for the docking rope, is self locking at any particular point in the payout of the dock rope, and, when locked and secured, provides a relatively smooth, uninterrupted surface with the deck of the boat for unobstructed passage thereover.

BRIEF SUMMARY OF THE INVENTION

This invention is directed to a boat mooring device connectable into a prepared hole formed through the deck of a boat, the device including a deck plate, a trunnion connected and extending from the unexposed surface of the deck plate, and a spring loaded rope wheel rotatably mounted about a transverse axis at the other end of the trunnion. The device is structured so that rope stored on the rope wheel may be payed out from, or retracted unto, the rope wheel through an aperture in the deck plate as desired. Thereafter, pivotally closing a draw lever hinge connected atop the deck plate's exposed surface activates a spring loaded pawl which lockably engages into one of a plurality of notches formed into the periphery of the rope wheel. When the device is in its closed and locked position, a relatively smooth and uninterrupted surface with the boat deck is provided, the locked mooring rope extending out through the deck plate aperture a desired length for connection to a dock or the like.

It is therefore an object of this invention to provide a device which will fully replace conventional deck cleats and serve as replacements therefor while also providing a means for storing a length of mooring rope.

It is another object of this invention to provide a self-locking boat deck mooring device which will automatically lock at any given length of mooring rope payed out upon the activation of a draw lever.

It is another object to provide the above invention as being relatively smooth and unobtrusive with the adjacent deck surfaces when the device is in its locked position.

In accordance with these and other objects which will become apparent hereinafter, the instant invention will now be described with reference to the accompanying drawings.

DETAILED DESCRIPTION OF THE INVENTION

Figure 1:
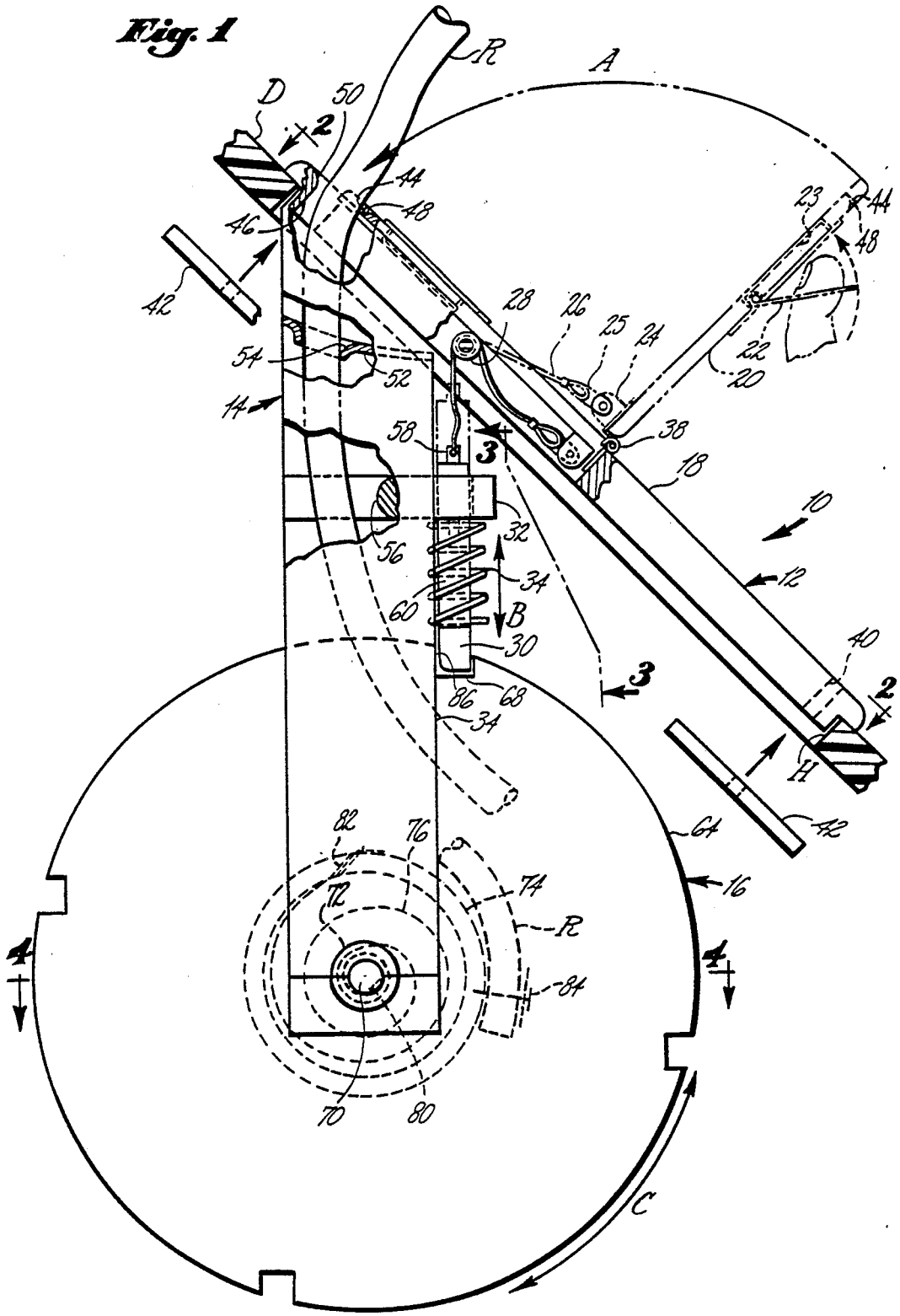
FIG. 1 is a side elevation, partially broken view of the invention.
Figure 4:
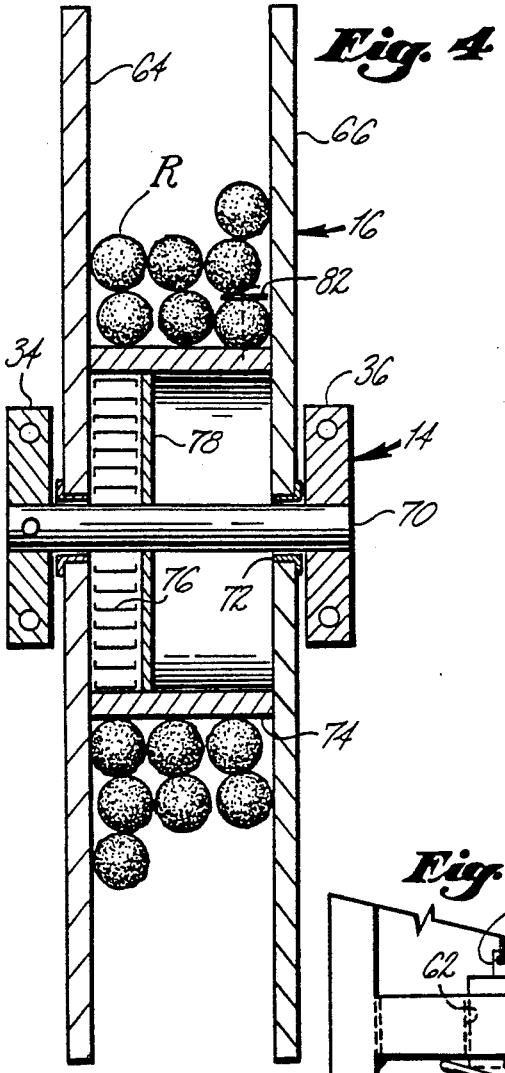
FIG. 4 is a section view in the direction of arrows 4—4 in FIG. 1.

Referring now the drawings, the invention is shown generally at numeral 10 connected to a deck D of a boat and includes a deck plate 12, a trunnion 14 and a rope wheel 16. The trunnion 14, formed of two spaced metal bars 34 and 36, is connected at one end to the unexposed surface of a rigid, flat plate 18 of deck plate 12. The rope wheel 16 is mounted for rotation in the direction of arrow C about a transverse axis at the other end of trunnion 14.

The deck plate 12 includes a cover or draw lever 20 which pivots in the direction of arrow A about hinge 38 connected to plate 18 at one end of an aperture 46 formed through plate 18. Plate 18 also includes a shoulder which mates within a hole H formed within deck D of a boat. Thus, the deck hole H overlaps and is at least in partial alignment with aperture 46 of plate 18.

The draw lever 20 includes a finger pull ring 22 which is pivotally connected within keeper 23 so that, when closed, the finger pull ring 22 is generally flush with the surface of draw lever 20 which, in turn, is generally flush with plate 18 when closed thereagainst.

Connected to the lower surface of draw lever 20 is an anchor bracket 24 to which is pivotally connected a cable yoke 25. The cable yoke 25 is connected to one end of a length of flexible cable 26. The other end of cable 26 is connected to an adjusting screw 58 which matably threads into shaft 60 mounted for slidable translation in the direction of arrow B within an aperture formed into guide bracket 32. Guide bracket 32 is, in turn, rigidly connected between bars 34 and 36 of trunnion 14.

Figure 3:
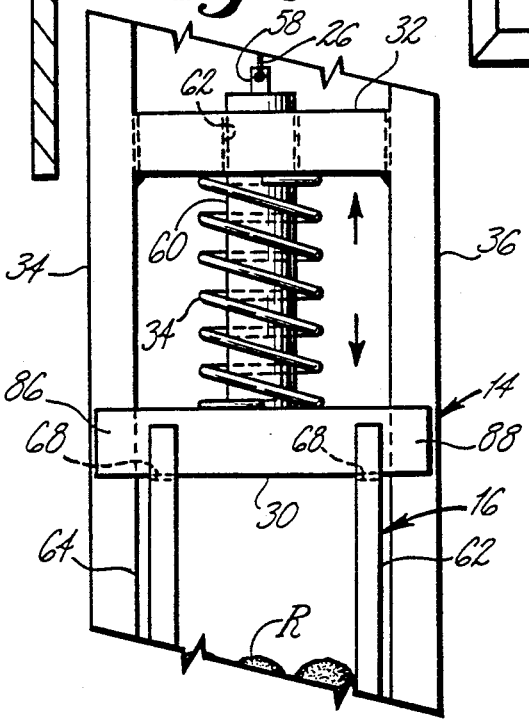
FIG. 3 is a view in the direction of arrows 3—3 in FIG. 1.

Connected transversely as best seen in FIG. 3 at the lower end of shaft 60 is transverse pawl 30. A coil spring 34 held in compression between guide bracket 32 and pawl 30 on shaft 60, tends to bias pawl 30 downwardly so as to press it against the periphery of side panels 62 and 64 of rope wheel 16. A plurality of notches 68 are formed in matched pairs into the periphery of each side panel 62 and 64 sized to matably receive pawl 30. Thus, coil spring 34 urges pawl 30 into one of the notches 68 as the rope wheel 16 is rotated sufficiently for alignment thereof.

By this arrangement, then, when draw lever 20 is in its closed position shown in solid in FIG. 1, pawl 30 is allowed to fall into one of notches 68, locking the rotational position of rope wheel 16. As draw lever 20 is opened toward the position shown in phantom in FIG. 1, cable 26 is tensioned, drawing pawls 30 out of the notch 68 into which it has been engaged, allowing the rope wheel 16 to otherwise rotate. To further strengthen the pawl's 30 ability to resist rotation of rope wheel 16 while within one of the notches 68, pawl 30 is designed to simultaneously abut the edge of each bar 34 and 36 at 86 and 88 as seen in FIGS. 1 and 3. Thus, approximately twice the shear strength of pawl 30 within a notch 66/68 is utilized to prevent counter clockwise rotation of the rope wheel 16.

The rope wheel 16 includes a cylindrical hub 74 centrally mounted between the side panels 64 and 66 about shaft 70. Shaft 70 is fixedly mounted within spaced bars 34 and 36 of trunnion 14, thus allowing rope wheel 16 to otherwise rotate freely on bushings 72 about shaft 70. Also provided within hub 74 is a spiral-coiled spring 76 which is connected at one end as best seen in FIG. 1 into shaft 70 at 80 and, connected at the other end within hub 74 at 82. Tensioning of coil spring 76 is such that a length of rope R anchored at 84 to the outer surface of hub 74 will wind itself onto hub 74 if not inhibited by either tension on the other end of the rope R or the locking action of pawl 30.

The other end of rope R is fed through a radiused aperture 56 formed into pawl guide 32, then through a formed eyelet 54 in a rope guide 52 connected between bars 34 and 36, and then out through hole H in deck D and aperture 46 in deck plate 12. Eyelet 54 is sized to slightly press against rope R so as to allow the rope R to be freely pulled back and forth therethrough, but to prevent the rope R from inadvertently falling down through eyelet 54.

Thus, when pawl 30 is disengaged from the notches 68, the rope R may be freely withdrawn by pulling any desired quantity thereof from rope wheel 16, at which point pawl 30 may be reengaged into one of the notches 68 by the pivotal closing of draw lever 20.

Figure 2:
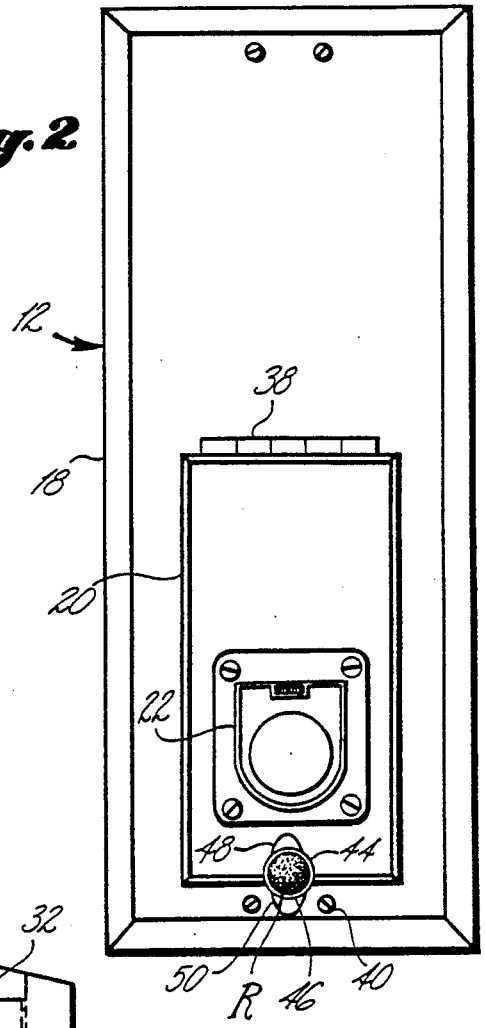
FIG. 2 is a top plan view of the invention in the direction of arrows 2—2 in FIG. 1.

As best seen in FIGS. 1 and 2, the distal end of draw lever 20 includes a groove 44 contoured at 48 which mates with groove 46 contoured at 50 formed into the aligning and corresponding surface of plate 18. This mating grooved and contoured structure between the distal end of draw lever 20 and the corresponding surface of plate 18 forms a relatively close fitting aperture around rope R so that, when draw lever 20 is closed, a finished non-chafing apertured appearance is provided which will not allow debris to fall therethrough.

In general, then, the deck plate 12 provides a relatively flush structure connected onto deck D within prepared hole H, held there securely by backing plates 42 and suitable mechanical fastening means. When closed, draw lever 20 against the exposed surface of plate 18 provides a nearly flush and unobtrusive surface over which deck hands may walk unobstructed.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A boat mooring device connectable to a deck of a boat comprising:

a deck plate having an exposed and an unexposed surface connectable atop a prepared hole formed into a surface of the deck, said deck plate having an aperture therethrough in alignment with the deck hole;

a draw lever pivotally connected at one end to said deck plate exposed surface over said deck plate aperture;

a trunnion connected at one end and extending from said deck plate unexposed surface;

a spring-biased rope wheel mounted for rotation about a transverse axis at the other end of said trunnion whereby one end of a length of rope secured at its other end and stored on a hub of said rope wheel will freely pass and feed through said deck plate aperture;

said rope wheel spring biasing tending to rotate said rope wheel in a direction such that the rope is wound onto said hub;

a spring-biased pawl slidably connected to said trunnion and having a first position wherein the distal end of said pawl lockably engages into one of a plurality of notches formed into the periphery of said rope wheel and a second position wherein the distal end of said pawl is disengaged from any of said plurality of notches;

said pawl spring biased toward said pawl first position;

a link acting between said draw lever and said pawl to move said pawl from said first position to said second position when said draw lever is pivoted from its closed position against said deck plate to an open position;

said device having a generally smooth, uninterrupted exposed surface with the deck when said draw lever is in its closed position.

2. A boat mooring device as set forth in claim 1, wherein said link includes:

a length of flexible cable connected at one end to said draw lever at a point on said draw lever spaced from said pivotal connection to said deck plate, the other end of said cable connected to the proximal end of said panel;

said point on said draw lever tensioning said cable as said draw lever is pivotally opened.

3. A boat mooring device as set forth in claim 2, further comprising:

a rope guide eyelet connected at a mid-point of said trunnion for slidably receiving the rope passing therethrough and for maintaining alignment of the rope between said rope wheel and said deck plate aperture.

4. A boat mooring device as set forth in claim 3, further comprising:

a groove formed in the distal end of said draw lever sized to mate around the rope as it passes out through said deck plate aperture and the deck hole when said draw lever is in its closed position.

5. A boat mooring device as set forth in claim 4, wherein said draw lever includes:

a finger pull ring pivotally connected to one end of the exposed surface of said draw lever;

said finger pull ring mounted within a finger pull ring keeper structured to provide a generally smooth, uninterrupted exposed surface of said draw lever against said deck plate.

* * * * *

UNITED STATES PATENT AND TRADEMARK OFFICE

CERTIFICATE OF CORRECTION

PATENT NO. : 5,002,003

DATED : March 26, 1991

INVENTOR(S) : James Blue

It is certified that error appears in the above-identified patent and that said Letters Patent is hereby corrected as shown below:

In column 4, line 35, replace "panel" with -- pawl --.

Signed and Sealed this

Fourth Day of August, 1992

*Attest:*

DOUGLAS B. COMER

*Attesting Officer*

*Acting Commissioner of Patents and Trademarks*